US009801477B2

(12) United States Patent
Krake et al.

(10) Patent No.: US 9,801,477 B2
(45) Date of Patent: Oct. 31, 2017

(54) PICTURE HANGING BRACKET AND METHOD OF INSTALLATION

(71) Applicant: Under the Roof Decorating Inc., Calgary (CA)

(72) Inventors: Kelly R. Krake, Calgary (CA); Liette Tousignant, Calgary (CA); Michael Kurtz, Calgary (CA)

(73) Assignee: UNDER THE ROOF DECORATING INC., Calgary (CA)

( * ) Notice: Subject to any disclaimer, the term of this patent is extended or adjusted under 35 U.S.C. 154(b) by 41 days.

(21) Appl. No.: 14/842,024

(22) Filed: Sep. 1, 2015

(65) Prior Publication Data

US 2017/0055729 A1 Mar. 2, 2017

(51) Int. Cl.
*A47G 1/16* (2006.01)
*A47G 1/06* (2006.01)

(52) U.S. Cl.
CPC ..... *A47G 1/1606* (2013.01); *A47G 1/06* (2013.01)

(58) Field of Classification Search
CPC ..... A47G 1/1606; A47G 1/06; A47G 1/1653; A47G 1/20; A47G 1/22
USPC ..... 248/475.1, 220.1, 216.1, 217.3
See application file for complete search history.

(56) References Cited

U.S. PATENT DOCUMENTS 1,159,813 A 11/1915 Volkhardt
1,340,711 A 5/1920 Greenwald
1,407,177 A 2/1922 Stone
1,496,282 A 6/1924 Taylor
1,633,859 A 6/1927 Harvey
2,010,660 A 8/1935 Ferris
2,204,862 A * 6/1940 Lehman ..... A47G 1/215 248/466
2,639,109 A 5/1953 Hoag
3,265,339 A 8/1966 Hushek
3,514,886 A 6/1970 Drakard
3,529,799 A 9/1970 Schaefer
3,692,265 A * 9/1972 Barriger ..... A47G 1/1653 248/220.1
3,787,934 A 1/1974 Gross
(Continued)

FOREIGN PATENT DOCUMENTS

FR 2835167 8/2003
GB 1031208 6/1966
(Continued)

*Primary Examiner* — Anita M King
(74) *Attorney, Agent, or Firm* — Norton Rose Fulbright Canada LLP; Alexandre Daoust

(57) ABSTRACT

A hanging bracket for hanging a picture frame having at least two right angled corners on a supporting structure. The bracket is a one-piece member formed of plastic having a planar base terminating with a beveled edge formed by two straight sections and an intervening arcuate section. A V-shaped column is spaced from the beveled edge by a V-shaped planar portion of the base and extends perpendicularly from the base terminating in a V-shaped top edge with two straight legs joined at a rounded corner. A pin is embedded in the rounded corner and extends outwardly beyond the straight legs of the column. The base is inserted between the back of a canvas picture and the two adjacent frame members at each corner of the picture frame with the projecting pins being pressed into the support structure to suspend the picture frame therefrom.

12 Claims, 6 Drawing Sheets

(56) References Cited

U.S. PATENT DOCUMENTS

| | | | | | |
|---|---|---|---|---|---|
| 3,861,639 | A | | 1/1975 | Morrill | |
| 4,040,149 | A | | 8/1977 | Einhorn | |
| 4,179,089 | A | * | 12/1979 | Parr, Jr. | A47G 1/215 248/201 |
| 4,348,826 | A | | 9/1982 | Reim | |
| 4,437,639 | A | | 3/1984 | Stein | |
| 4,458,873 | A | | 7/1984 | Sutherland | |
| 4,606,526 | A | | 8/1986 | Rabinowitz | |
| 4,689,906 | A | | 9/1987 | Sherman | |
| 4,809,859 | A | | 3/1989 | Chung | |
| D303,942 | S | * | 10/1989 | Bottcher | D11/164 |
| 5,189,820 | A | | 3/1993 | Komamura | |
| 5,199,681 | A | | 4/1993 | Reidy | |
| 5,249,765 | A | | 10/1993 | Garcia | |
| 5,255,458 | A | | 10/1993 | Piel | |
| 5,265,358 | A | | 11/1993 | Borod | |
| 5,279,056 | A | | 1/1994 | Komamura | |
| 5,303,895 | A | | 4/1994 | Hart | |
| 5,464,185 | A | | 11/1995 | Hensley | |
| 5,799,429 | A | | 9/1998 | Speshyock | |
| 5,947,437 | A | * | 9/1999 | Tate | A47G 1/0638 248/216.1 |
| 6,042,078 | A | * | 3/2000 | Donovan | A47G 1/205 248/489 |
| 6,439,520 | B1 | | 8/2002 | Johnson | |
| 6,682,033 | B1 | | 1/2004 | Cohen et al. | |
| 6,719,260 | B1 | | 4/2004 | Hart | |
| 6,729,060 | B1 | * | 5/2004 | Rietkerk | A47G 1/0616 40/738 |
| 7,313,880 | B2 | | 1/2008 | Yamagishi | |
| D572,122 | S | | 7/2008 | Cave | |
| 8,104,208 | B2 | | 1/2012 | Schymura | |
| 8,342,472 | B2 | | 1/2013 | Gaudron et al. | |
| 8,632,044 | B2 | | 1/2014 | Cave | |
| 8,740,171 | B2 | | 6/2014 | Crescenzo | |
| 8,793,910 | B2 | | 8/2014 | Froio et al. | |
| 8,898,945 | B2 | | 12/2014 | Miller | |
| RE45,475 | E | | 4/2015 | Schymura | |
| 9,259,105 | B2 | | 2/2016 | Van Bartel | |
| D753,465 | S | | 4/2016 | Marsh | |
| 2005/0006552 | A1 | | 1/2005 | Giles | |
| 2007/0210234 | A1 | | 9/2007 | Lin | |
| 2009/0064555 | A1 | | 3/2009 | Schymura | |
| 2009/0113776 | A1 | | 5/2009 | Van Bartel | |
| 2009/0193674 | A1 | | 8/2009 | Megahed | |
| 2009/0294610 | A1 | | 12/2009 | Paharik | |
| 2012/0036754 | A1 | | 2/2012 | Van Bortel | |
| 2014/0173923 | A1 | | 6/2014 | Van Bartel | |
| 2017/0055730 | A1 | * | 3/2017 | Krake | A47G 1/1633 |
| 2017/0055732 | A1 | * | 3/2017 | Krake | A47G 1/205 |
| 2017/0059084 | A1 | * | 3/2017 | Krake | G04B 37/144 |

FOREIGN PATENT DOCUMENTS

| | | |
|---|---|---|
| JP | 3872881 | 1/2007 |
| JP | 2015203780 | 11/2015 |
| KR | 100541232 | 1/2006 |
| KR | 20130035592 | 4/2013 |
| WO | 8504789 | 11/1985 |

* cited by examiner

PICTURE HANGING BRACKET AND METHOD OF INSTALLATION

BACKGROUND OF THE INVENTION

Technical Field

The invention relates to a bracket for hanging pictures onto a supporting wall or structure. More particularly, the invention relates to a picture hanging bracket and method of use for hanging canvas art wherein the hanger is slidably inserted between the canvas and frame and has a protruding pin for insertion into the supporting structure.

Background Information

Canvas art typically comes without an external frame in contrast to most pictures and art work which come in a frame. The canvas is stretched and stapled to an internal frame made of wood. The size of the canvas can vary greatly but the height of the frame (i.e. the distance from the wall to the attached canvas) has several standard sizes.

There is currently a limited number of options available to hang canvas art attached to these internal frames. One is to hang the wooden frame on one or more nails secured in the wall. The problem with this is that it doesn't secure the canvas and frame to the wall so it can fall off if bumped. Another option requires the installation of additional hardware on the frame. The hardware could be picture wire, D-ring hangers, a sawtooth hanger, etc. This hardware requires tools and prevents the frame from being flush against the wall.

Therefore the need exists for a bracket which can securely attach framed canvas art in a flush manner to a support structure without securing additional hardware to the frame as heretofore required.

SUMMARY

In one aspect, the invention may provide a hanging bracket comprising: a planar base having top and bottom surfaces terminating in a beveled edge; a V-shaped column extending generally perpendicularly from the top surface of the base having first and second legs forming a right angle therebetween and terminating in peripheral edges joined at a corner, said column being spaced from the beveled edge by a portion of the planar base; and a pin embedded in and extending from the corner of the column beyond the peripheral edges of the legs.

In another aspect, the invention may provide a rectangular picture frame and a pair of hanging brackets for hanging said picture frame on a support structure; said picture frame comprising a plurality of frame members forming at least two right angled corners, said frame members having front surfaces, rear surfaces and opposed side surfaces; and a sheet of material extending across the front surfaces of the frame members; each of said hanging brackets comprising: a planar base having top and bottom surfaces terminating in a beveled edge; a V-shaped column having first and second legs joined at a corner, said column extending generally perpendicularly from the top surface of the base and terminating in an outer peripheral edge, said column being spaced from the beveled edge; and a pin extending from the corner beyond the peripheral edge of the column; said beveled edge of each hanging bracket inserted between the front surfaces of two frame members and the sheet of material, said two frame members forming one of the right angled corners, with the legs of the V-shaped columns abutting against the side surfaces of said frame members.

In another aspect, the invention may provide a method of installing a hanging bracket on a canvas art having a rectangular frame and a canvas attached to and stretched across a front of the frame, including the step of: providing a bracket having a planar base terminating in a beveled edge, and having a V-shaped column with two leg members terminating in a corner extending upwardly from the base and spaced from the beveled edge, and having a pin extending from the corner; and inserting the beveled edge and planar base of a pair of the brackets between the canvas and back of the frame at two upper corners of the rectangular frame until the column abuts the frame members forming said corners.

BRIEF DESCRIPTION OF THE SEVERAL VIEWS OF THE DRAWINGS

A sample embodiment of the invention is set forth in the following description, is shown in the drawings and is particularly and distinctly pointed out and set forth in the appended claims.

Similar numbers refer to similar parts throughout the drawings.

DETAILED DESCRIPTION

Figure 1:
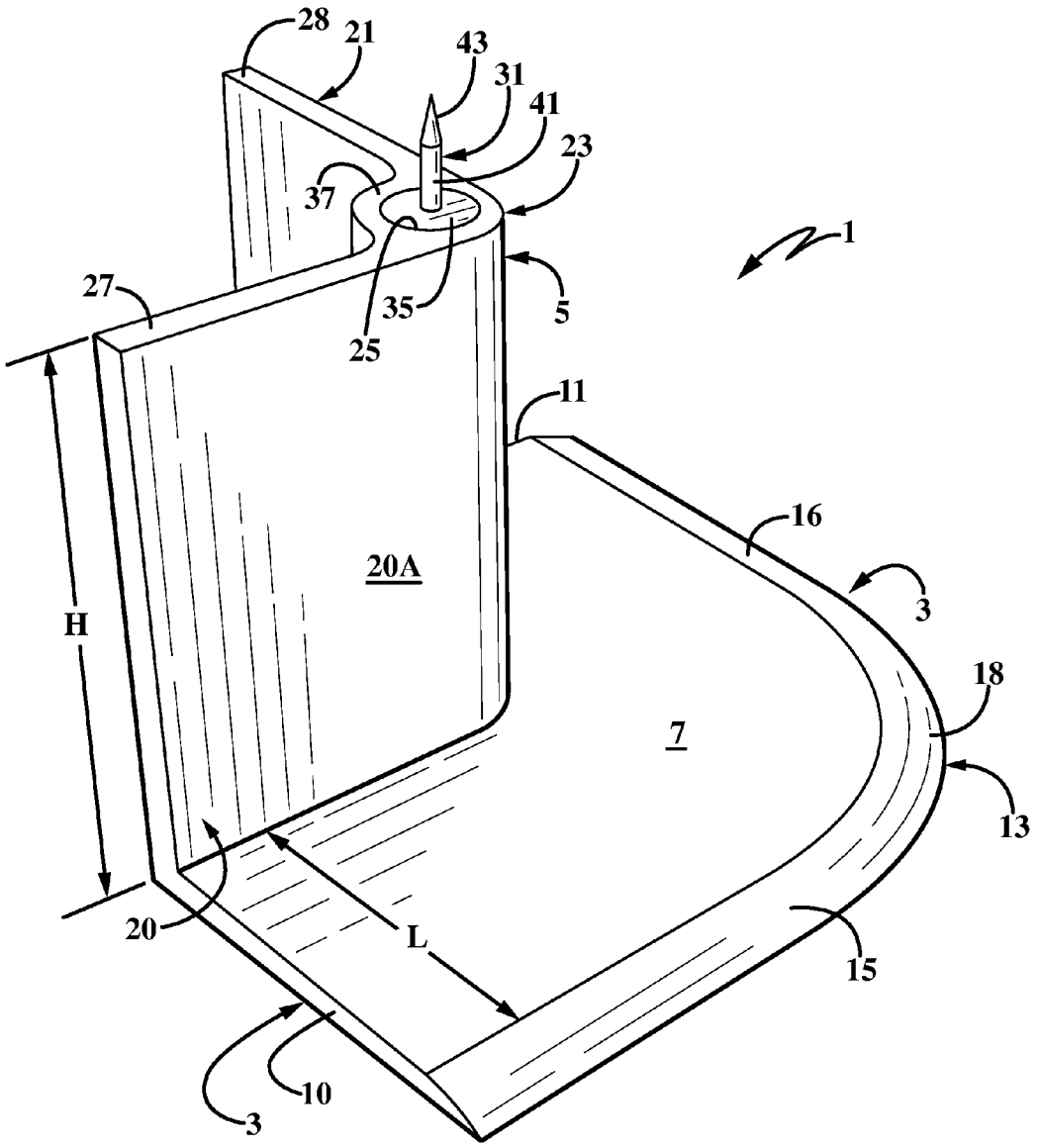
FIG. 1 is a top perspective view of the picture hanging bracket.
Figure 2:
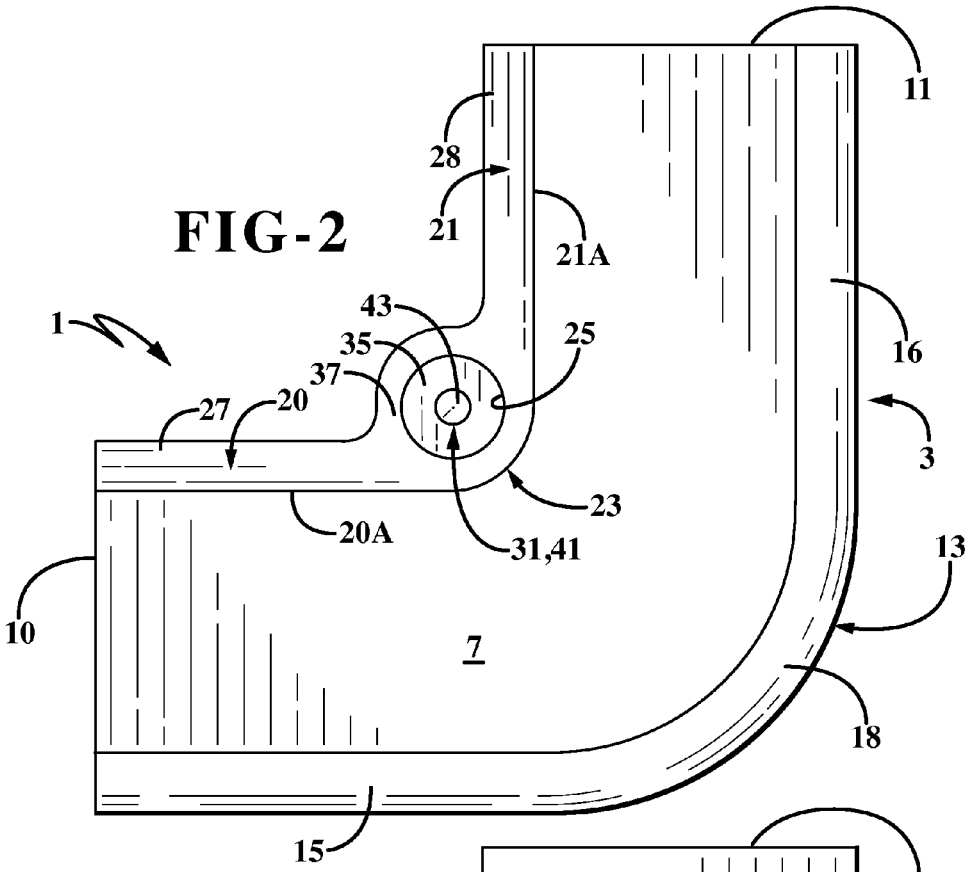
FIG. 2 is a top plan view thereof.
Figure 3:
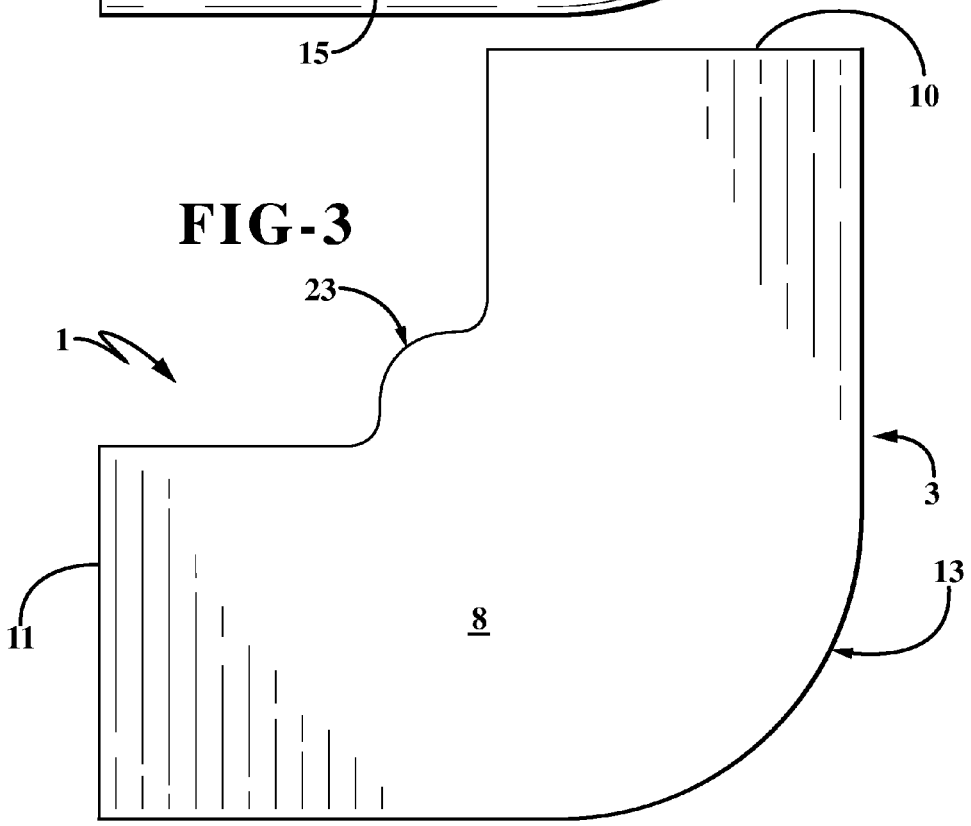
FIG. 3 is a bottom plan view thereof.

The picture hanging bracket of the present invention is indicated generally at 1, and is shown in FIG. 1. Bracket 1 preferably is formed of a one-piece molded plastic material and includes a main base indicated generally at 3, and an upwardly extending column indicated generally at 5. Base 3 has a planar top surface 7 and a parallel planar bottom surface 8 (FIG. 3) with straight side edges 10 and 11 which merge with a beveled edge indicated generally at 13. Beveled edge 13 includes a pair of straight beveled sections 15 and 16 which merge into an arcuate corner section 18 which has an arcuate length of approximately 45 degrees.

Figure 4:
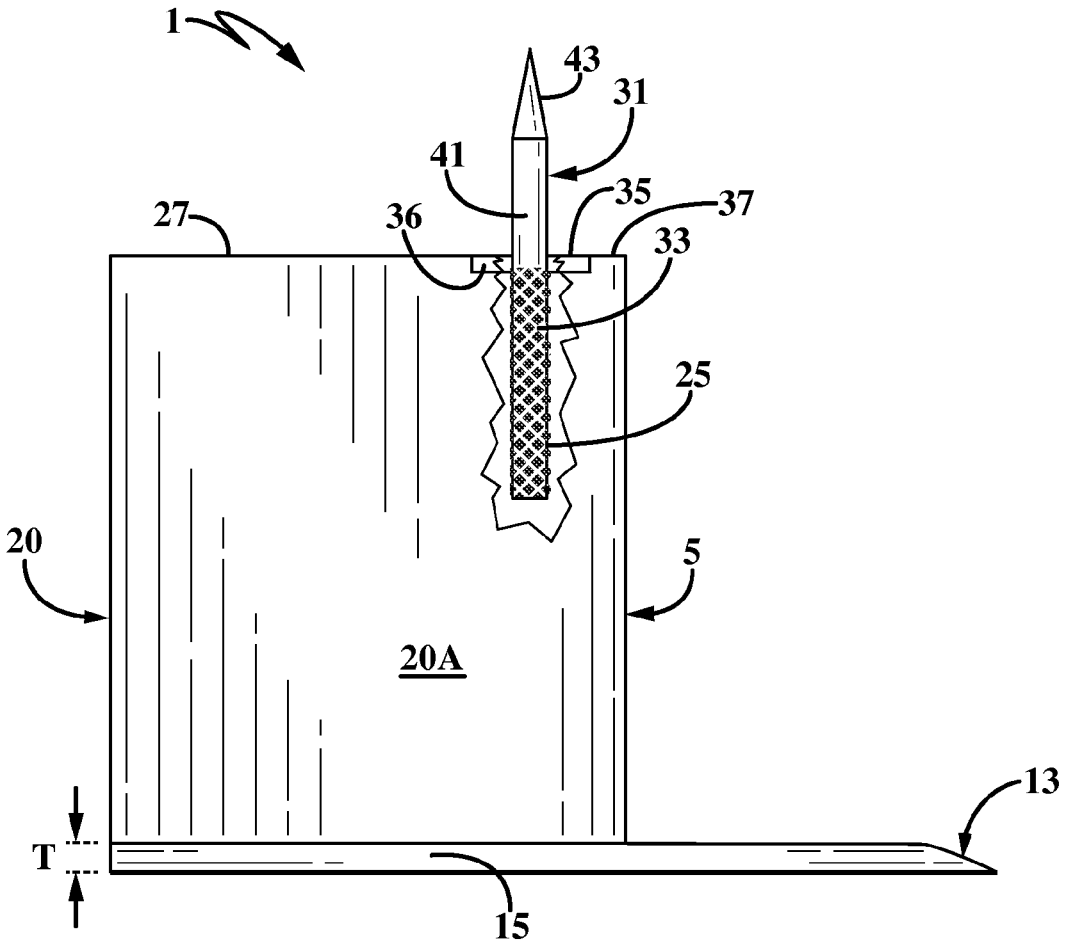
FIG. 4 is a side elevational view with portions broken away.
Figure 5:
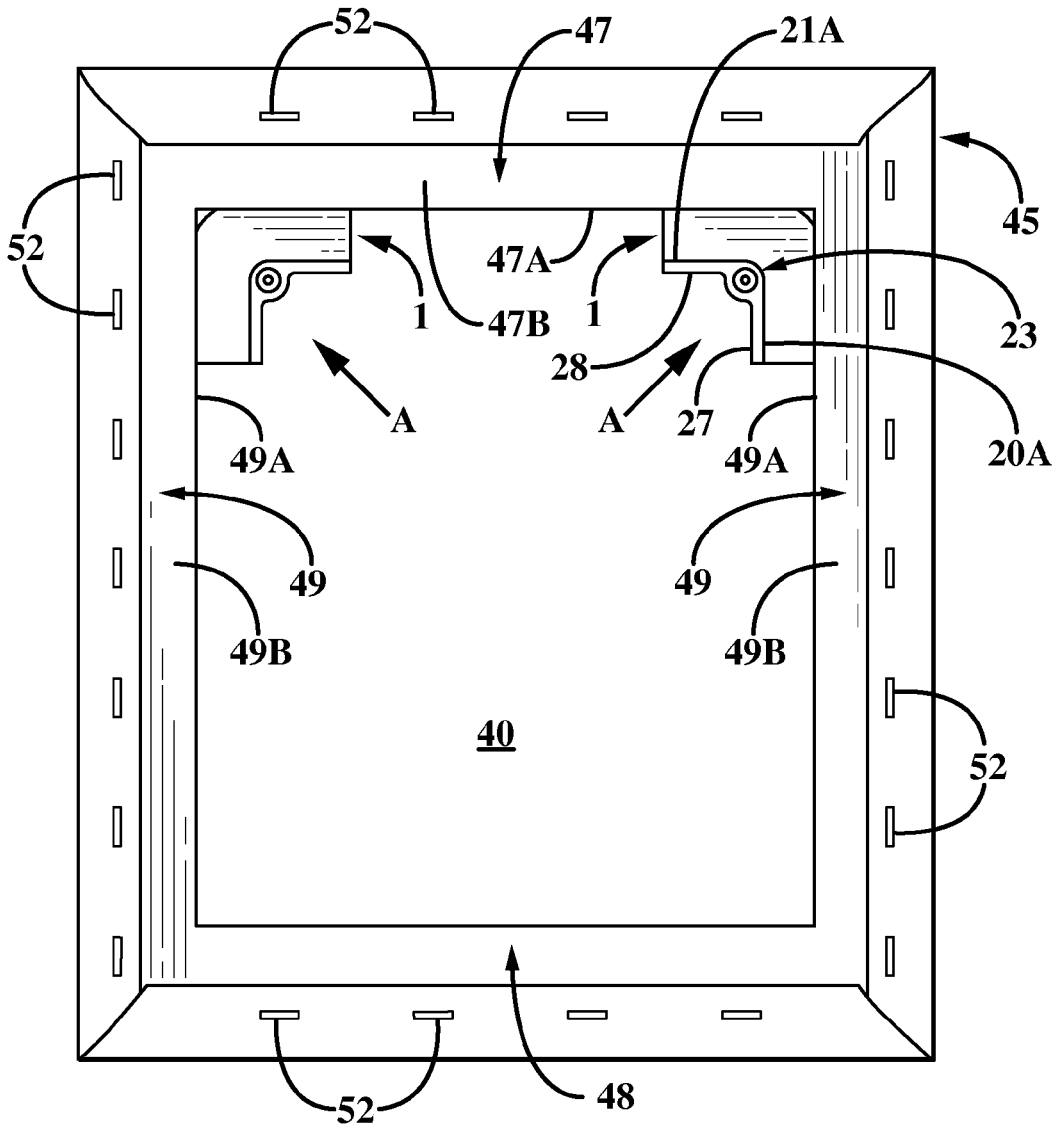
FIG. 5 is a rear plan view of two of the hanging brackets being installed on a piece of canvas art.

Column 5 includes a pair of legs 20 and 21 which terminate in a rounded corner indicated at 23. Rounded corner 23 has a generally circular shape and is formed with a cylindrical hole 25 extending at least partially into the rounded corner (FIG. 4). Legs 20 and 21 are preferably similar in size and configuration and terminate in top edges 27 and 28 respectively, which form a right angle therebetween and merge at rounded corner 23. Column 5 is spaced from beveled edge 13 providing a generally V-shaped configuration to planar top surface 7 of base 3.

An attachment pin indicated generally at 31, includes a knurled cylindrical base 33 (FIG. 4) which is embedded within hole 25 until an annular stop flange or cap 35 is substantially flush with the circular top planar surface 37 surrounding hole 25. Flange 35 preferably will be seated in a counterbore hole 36 formed about the upper portion of hole 25 so that it has a common plane with top edges 27 and 28 of column 5. The other end of pin 31 is formed with a short cylindrical section 41 terminating in pointed tip 43. Base 3 and column 5 preferably is a one-piece member molded of a plastic material and pin 31 preferably is made of metal such as a zinc-plated steel.

A usual canvas picture frame is indicated generally at 45, and is shown in FIGS. 5-8. Frame 45 will usually have a rectangular shape with top and bottom frame members 47 and 48 and a pair of opposed parallel side frame members 49 joined together at right angled corners to form the rectangular frame. When used for mounting canvas art or a painting 40 thereon, the canvas is stretched over the front surfaces of the frame members and around the edges thereof where it is then secured by a plurality of staples 52 to the frame members. The frames for most types of canvas paintings will have only several thicknesses or depths as indicated at D in FIG. 7. These frame members generally have a rectangular cross-section with the four sides being generally planar. Occasionally, a smaller rectangular frame (not shown) will be formed on the inside of the main frame to provide a step configuration thereto. However, bracket 1 will work equally well with such a step frame or with plain rectangular frame members as shown in the drawings.

Bracket 1 preferably will be made in several sizes, and in particular with the height of column 5 being the critical adjustable size. The size and configuration of planar top surface 7 of base 3 as well as the thickness T thereof can be the same with only the height (H) of column 5 being adjustable to match the common sizes or thicknesses (D) of the canvas frame members.

Figure 6:
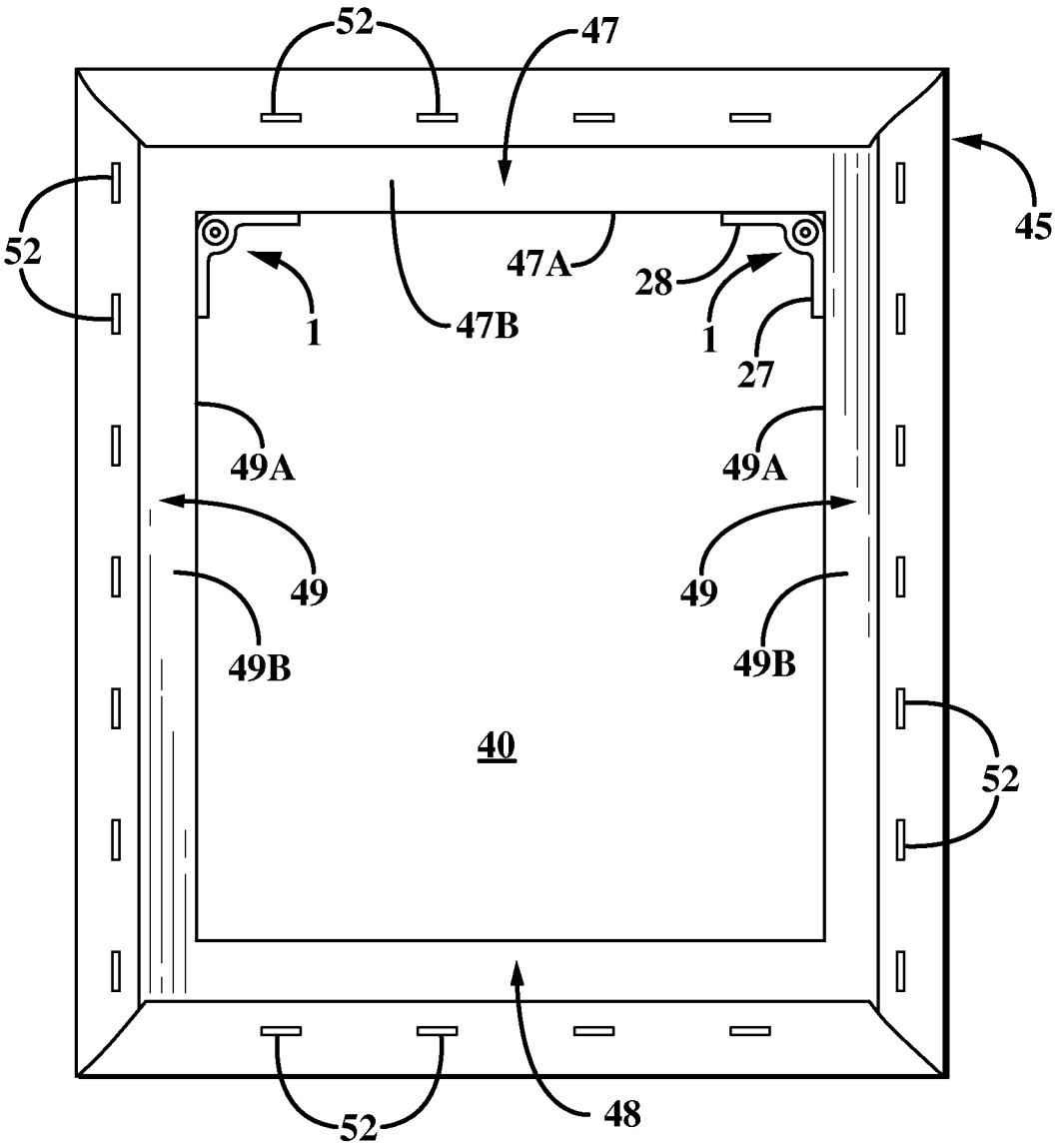
FIG. 6 is a view similar to FIG. 5 showing the two hanging brackets completely installed to the canvas art.

The method of installing bracket 1 on the canvas frame without requiring any tools or additional fasteners and attaching it to a supporting structure is shown in FIGS. 5-8. Beveled edge 13 is slidably inserted between the inside surface of canvas painting 40 and the adjacent surfaces of the corner frame members at the right angle junction thereof. Bracket 1 is pressed inwardly as shown by Arrows A, FIG. 5 until the right angle corner 23 formed by the surfaces 20A and 21A of legs 20 and 21 abut the exposed surfaces 47A and 49A of top and adjacent side frame members 47 and 49 as shown in FIG. 6.

Figure 7:
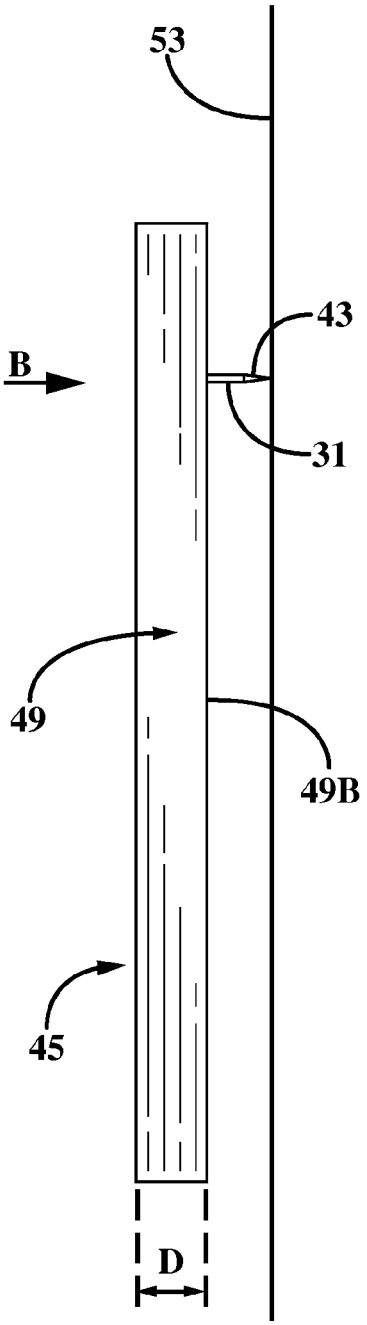
FIG. 7 is a side view of the canvas art just before being attached to a supporting structure.
Figure 8:
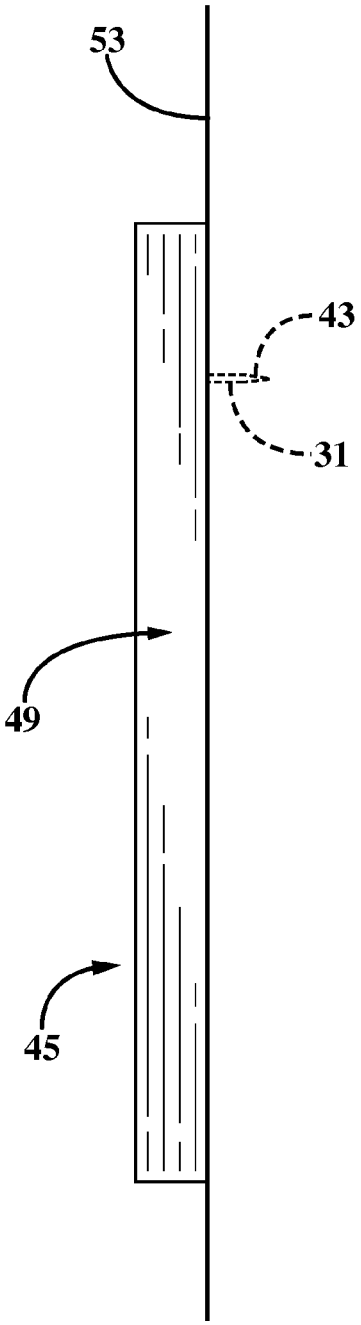
FIG. 8 is a view similar to FIG. 7 showing the canvas art completely attached to the supporting structure.

One of the principal features is that the height (H) of column legs 20 and 21 is approximately equal to the thickness or depth D of the frame members so that when installed thereon as shown in FIG. 6, top edges 27 and 28 of column legs 20 and 21 will be parallel and lie in the same plane as the back surfaces 47B and 49B of frame members 47 and 49 with only pointed end 43 of pin 31 extending beyond the back surfaces of the frame members. After a pair of brackets 1 is installed in the top corners of frame 45, the frame is placed against a wall 53 or similar mounting surface as shown in FIG. 7 and pressed firmly thereagainst in the direction of Arrow B. This presses pointed ends 43 of pins 31 into the wall as shown in FIG. 8. Pins 31 will support frame 45 on and flush against the wall surface with no visible mounting hangers or hanging hardware as heretofore required.

Thus, a canvas painting 40 is easily mounted on a wall requiring only two small puncture holes caused by pointed ends 43 and cylindrical sections 41 of pins 31, which pins are easily installed on the back of the canvas painting without requiring additional fasteners or other components. Furthermore, a pair of brackets 1 is easily installed as discussed above by slidably inserting beveled edges 13 between the back of the canvas painting and the adjacent frame members until the V-shape of column 5 nests within the right angled corner formed by the frame members.

Bracket 1 for most canvas frames will have column 5 with a height H in the range of 10 mm to 60 mm which is the range of depth D of many canvas art frames. Planar base 3 will have a thickness T of approximately 1.5 mm with the length L of side edges 10 and 11 (FIG. 1) being approximately 24 mm. These dimensions can vary without affecting the concept of the invention.

It is also readily understood that bracket 1 can be used with other type paintings and art work or even other objects in which the planar base 7 can be slid between a front facing and two adjacent frame members forming right corners.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration set out herein are an example and the invention is not limited to the exact details shown or described.

The invention claimed is:

1. A hanging bracket comprising:

a planar base having top and bottom surfaces terminating in a beveled edge;

a V-shaped column extending generally perpendicularly from the top surface of the base and having first and second legs forming a right angle therebetween and terminating in peripheral edges joined at a corner, said column being spaced from the beveled edge by a portion of the planar base; and a pin embedded in and extending from the rounded corner of the column beyond the peripheral edges of the legs;

the rounded corner of the column having a generally circular configuration and is formed with a cylindrical hole; and the pin having a knurled cylindrical base which is embedded in the cylindrical hole, an opposite pointed end, and an annular flange between the cylindrical base and pointed end.

2. The hanging bracket as defined in claim 1 wherein the peripheral edges of the legs lie in a common plane with a top surface of the rounded corner; and in which the annular flange lies in said common plane.

3. In combination, a rectangular picture frame and a pair of hanging brackets for hanging said picture frame on a support structure;

said picture frame comprising a plurality of frame members forming at least two right angled corners, said frame members having front surfaces, rear surfaces and opposed side surfaces;

each of said hanging brackets comprising: a planar base having top and bottom surfaces terminating in a beveled edge; a V-shaped column having first and second legs joined at a corner, said column extending generally perpendicularly from the top surface of the base and terminating in an outer peripheral edge, said column being spaced from the beveled edge; and a pin extending from the corner beyond the peripheral edge of the column;

said beveled edge of each hanging bracket inserted between the front surfaces of two frame members and the sheet of material, said two frame members forming one of the right angled corners, with the legs of the V-shaped columns abutting against the side surfaces of said frame members.

4. The combination defined in claim 3 wherein the height of the columns is equal to the length of the side surfaces of the frame members.

5. The combination defined in claim 3 wherein the top surface of the planar base is V-shaped and extends between the beveled edge and the column and includes a pair of straight side edges extending between the beveled edge and the column; and in which the V-shaped planar base is between the sheet of material and adjacent surfaces of the frame members forming the right angle corners.

6. The combination defined in claim 3 wherein the corner of the column is nested within the right angled corner formed by the frame members.

7. The combination defined in claim 3, wherein four frame members form a rectangular frame; and wherein a sheet of material extends across the front surfaces of the frame members.

8. The combination defined in claim 7 wherein four frame members form a rectangular frame; and in which the sheet of material is canvas art.

9. A method of installing a hanging bracket on a canvas art having a rectangular frame and a canvas attached to and stretched across a front of the frame, including the step of:

providing a bracket having a planar base terminating in a beveled edge, and having a V-shaped column with two leg members terminating in a corner extending upwardly from the base and spaced from the beveled edge, and having a pin extending from the corner; and inserting the beveled edge and planar base of a pair of the brackets between the canvas and back of the frame at two upper corners of the rectangular frame until the column abuts the frame members forming said corners.

10. The method defined in claim 9 including the step of:

pressing the pins into a supporting structure to suspend the canvas art on the structure free of any additional supporting hardware.

11. The method defined in claim 9 including the step of forming the planar base and column as a one-piece member of molded plastic.

12. A hanging bracket comprising:

a planar base having top and bottom surfaces terminating in beveled edge;

a V-shaped column extending generally perpendicularly from the top surface of the base and having first and second legs extending perpendicularly from one another, said column being spaced from the beveled edge by a portion of planar base; and a pin embedded in the planar base and extending beyond the legs, the planar base being formed with a cylindrical hole, and the pin having knurled cylindrical base which is embedded in the cylindrical hole, an opposite pointed end, and an annular flange between the cylindrical base and pointed end.

* * * * *